US008187041B2

(12) United States Patent
Ito

(10) Patent No.: US 8,187,041 B2
(45) Date of Patent: May 29, 2012

(54) COUPLING CONNECTOR

(75) Inventor: Yoshitaka Ito, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/920,813

(22) PCT Filed: Mar. 5, 2009

(86) PCT No.: PCT/JP2009/054200

§ 371 (c)(1),
(2), (4) Date: Sep. 2, 2010

(87) PCT Pub. No.: WO2009/110566

PCT Pub. Date: Sep. 11, 2009

(65) Prior Publication Data

US 2011/0014820 A1 Jan. 20, 2011

(30) Foreign Application Priority Data

Mar. 5, 2008 (JP) ..... P2008-055100

(51) Int. Cl.
*H01R 13/502* (2006.01)

(52) U.S. Cl. ..... 439/701; 439/541.5

(58) Field of Classification Search ..... 439/541.5, 439/701

See application file for complete search history.

(56) References Cited

U.S. PATENT DOCUMENTS

| | | | | |
|---|---|---|---|---|
| 4,867,712 | A | 9/1989 | Kato et al. | |
| 5,288,250 | A | 2/1994 | Sumida | |
| 5,288,251 | A | 2/1994 | Sumida | |
| 5,320,555 | A * | 6/1994 | Okabe | 439/354 |
| 5,643,015 | A * | 7/1997 | Wakata | 439/701 |
| 5,954,533 | A * | 9/1999 | Hatagishi et al. | 439/397 |
| 6,106,326 | A * | 8/2000 | Schramme | 439/460 |
| 7,297,032 | B2 * | 11/2007 | Kobayashi et al. | 439/701 |
| 2011/0014820 | A1 * | 1/2011 | Ito | 439/701 |

FOREIGN PATENT DOCUMENTS

| | | |
|---|---|---|
| JP | 63-111777 | 7/1988 |
| JP | 02-223171 | 9/1990 |
| JP | 09-017496 | 1/1997 |
| JP | 2006-190496 | 7/2006 |
| JP | 2007-095360 | 4/2007 |

* cited by examiner

*Primary Examiner* — James Harvey

(74) *Attorney, Agent, or Firm* — Finnegan, Henderson, Farabow, Garrett & Dunner, L.L.P.

(57) ABSTRACT

In a coupling connector formed by stacking two connector housings (10A, 20A) vertically on each other and coupling the two connector housings (10A, 20A) to each other, the two connector housings (10A, 20A) having terminal housing chambers (11, 21) into which terminals (111, 121) are inserted from rear ends thereof insertion recessed portions (16, 25) are provided on upper and lower surfaces of the stacked connector housings, respectively, while shifting positions thereof from each other, and terminal engaging projection portions (15, 26) are provided, which are inserted into the insertion recessed portions of the opposite-side connector housings opposite thereto when the connector housings are stacked on each other, and thereby inhibit rearward detachment of the terminals inserted into the terminal housing chambers of the opposite-side connector housings.

3 Claims, 16 Drawing Sheets

(a)

(b)

(a)

(b)

COUPLING CONNECTOR

TECHNICAL FIELD

The present invention relates to a coupling connector formed by stacking and coupling a plurality of connector housings vertically to each other.

BACKGROUND ART

FIG. 1 illustrates an embodiment of a conventional coupling connector described in PTL 1. This conventional coupling connector is formed by vertically stacking three connectors 210, 220, and 230, and coupling the three connectors 210, 220, and 230 integrally with one another.

The respective connector housings 210A, 220A, and 230A receive insertion of terminals 250 from rear ends thereof into terminal housing chambers 241 thereof Then, lance engaging recessed portions 251 of the respective terminals 250 engage with flexible lances 242 provided in the respective terminal housing chambers 241. As a result, the respective terminals 250 are primarily engaged so as not to be detached to the rear.

Moreover, in the connector housings 210A and 220A of the upper and middle connectors 210 and 220, on the respective lower surfaces thereof; terminal engaging projection portions 212 and 222 are protruded. Meanwhile, the connector housings 220A and 230A of the middle and lower connectors 220 and 230 include, on the respective upper surfaces thereof; insertion recessed portions 221 and 231 into which the terminal engaging projection portions 212 and 222 protruded on the lower surfaces of the connector housings 210A and 220A located thereabove are inserted. Then, when the connectors 210, 220, and 280 are coupled to one another, the terminal engaging projection portions 212 and 222 enter from the insertion recessed portions 221 and 231, and engage with constricted portions 252 of the terminals 250 inserted in advance into the terminal housing chambers 241. As a result, the respective terminals 250 are secondarily engaged so as not to be detached to the rear.

Furthermore, in the lances 242 of the upper and middle connector housings 210A and 220A, lower sides thereof are opened. Then, upper walls 223 and 233 of the connector housings 220A and 230A located therebelow fit to the respective opened portions of the lances 242. As a result, deflection of the lances 242 is restrained.

Moreover, FIGS. 2 and 3 illustrate a conventional coupling connector described in PTL 2. This conventional coupling connector is formed by stacking two connectors 310 and 320 vertically on each other further stacking a cover 330 on the uppermost portion of the two connectors 310 and 320, and coupling the two connectors 310 and 320 and the cover 330 integrally with one another. On a lower surface of a housing of the upper connector 320 and a lower surface of the cover 330, terminal engaging projection portions 322 and 332 are provided. Moreover, on an upper surface of a housing of the lower connector 310 and an upper surface of a housing of the lower connector 310, insertion recessed portions which the terminal engaging projection portion 322 of the upper connector 320 and the terminal engaging projection portions 332 of the cover 330 enter, respectively, are provided.

Then, when the connectors 310 and 320 and the cover 330 are coupled to one another, the terminal engaging projection portions 322 and 332 enter from the insertion recessed portions, and engage with constricted portions of terminals 350 inserted in advance into terminal housing chambers 311 and 321. As a result, the terminals 350 are engaged was not to be detached to the rear.

Citation List

Patent Literature

[PTL 1] JP 2007-95360A

[PTL 2] JP 2006-190496 A

SUMMARY OF INVENTION

However, in the conventional coupling connector illustrated in FIG. 1, detachment prevention of the terminal 250 of the upper connector 210 is performed only by restraining the deflection of the lance 242. Hence, in the case where large detaching force acts on the terminal 250, there is an apprehension that the terminal 250 may be detached since the lance 242 is broken.

Moreover, in the conventional coupling connector illustrated in FIGS. 2 and 3, detachment prevention of each terminal 350 of the upper connector 320 is performed by using the terminal engaging projection portion 332 provided on the cover 330. Hence, the cover 330 becomes essential besides the connector 310 and 320, and there is a problem that the number of components is increased.

In consideration of the above-described circumstances, it is an object of the present invention to provide a coupling connector capable of exerting sufficient terminal holding force on any stage thereof by means of the minimum number of components.

A coupling connector according to a first aspect of the present invention includes: a plurality of connector housings stacked vertically on each other and coupled to each other, the connector housings including terminal housing chambers; and terminals inserted into the terminal housing chambers of the connector housings from rear ends thereof each terminal having a constricted portion. Moreover, the connector housings include: insertion recessed portions arranged, while shifting positions thereof from each other, respectively on a mating wall of one of the connector housings and a mating wall of other connector housing among a pair of the connector housings directly stacked on each other; and terminal engaging projection portions which are arranged on the mating wall of the one of the connector housings and the mating wall of the other connector housing, are insertable into the insertion recessed portions provided on the mating walls of the opposite-side connector housings opposite thereto when the connector housings are stacked on each other, engage with the constricted portions of the terminals inserted into the terminal housing chambers of the opposite-side connector housings by being individually inserted to a final engagement position, and inhibit rearward detachment of the terminals thus engaged.

With such a configuration, at the time when the connector housings are coupled to each other, the terminal engaging projection portions provided on the opposite-side connector housings mutually engage with the constricted portions of the terminals, and the terminals are prevented from being detached. Hence, without requiring a superfluous cover or the like, the coupling connector according to the first aspect of the present invention can exert the sufficient terminal holding force on any stage thereof by means of the minimum number of components.

Moreover, it is preferable that the coupling connector according to the first aspect of the present invention further include: temporarily engaging means for holding both of the connector housings at a temporal engagement position; and finally engaging means for holding both of the connector housings at the final engagement position, wherein the temporarily engaging means and the finally engaging means are provided in the one of the connector housings and the other connector housing.

With such a configuration, the connector housings are held distinctively at the temporal engagement position and the final engagement position. Hence, the coupling connector can be assembled with ease.

Furthermore, in the coupling connector according to the first aspect of the present invention, it is preferable that plural stages of the terminal housing chambers are provided vertically in at least one connector housing of the pair of connector housings, and it is preferable that engagement well portions are provided on the terminal engaging projection portions in the other connector housing stacked on the one connector housing by the number of vertical stages of the terminal housing chambers of the one connector housing, the engagement wall portions allowing insertion of the terminals into the terminal housing chambers of the one connector housing when both of the connector housings are located at the temporal engagement position, and engaging the terminals inserted into the terminal housing chambers of the one connector housing when both of the connector housings are located at the final engagement position.

With such a configuration, the terminals are inserted into the terminal housing chambers of the respective connector housings in a state where the connector housings are held at the temporal engagement position. Then, the connector housings are thereafter pushed to the final engagement position, whereby the connector housings are coupled to each other, and the terminals are engaged with the connector housings so as to be prevented from being detached. Hence, the coupling connector can be assembled with ease.

BRIEF DESCRIPTION OF DRAWINGS

FIG. 2(*a*) is a perspective view illustrating a stats when the coupling connector is subjected to temporal engagement; and FIG. 2(*b*) is a perspective view illustrating when the coupling connector is subjected to final engagement.

FIG. 3(*b*) is a cross-sectional view illustrating the state when the coupling connector is subjected to the final engagement.

FIG. 8 is cross-sectional view taken along arrows 8-8 of FIG. 7.

DESCRIPTION OF EMBODIMENTS

Figure 1:
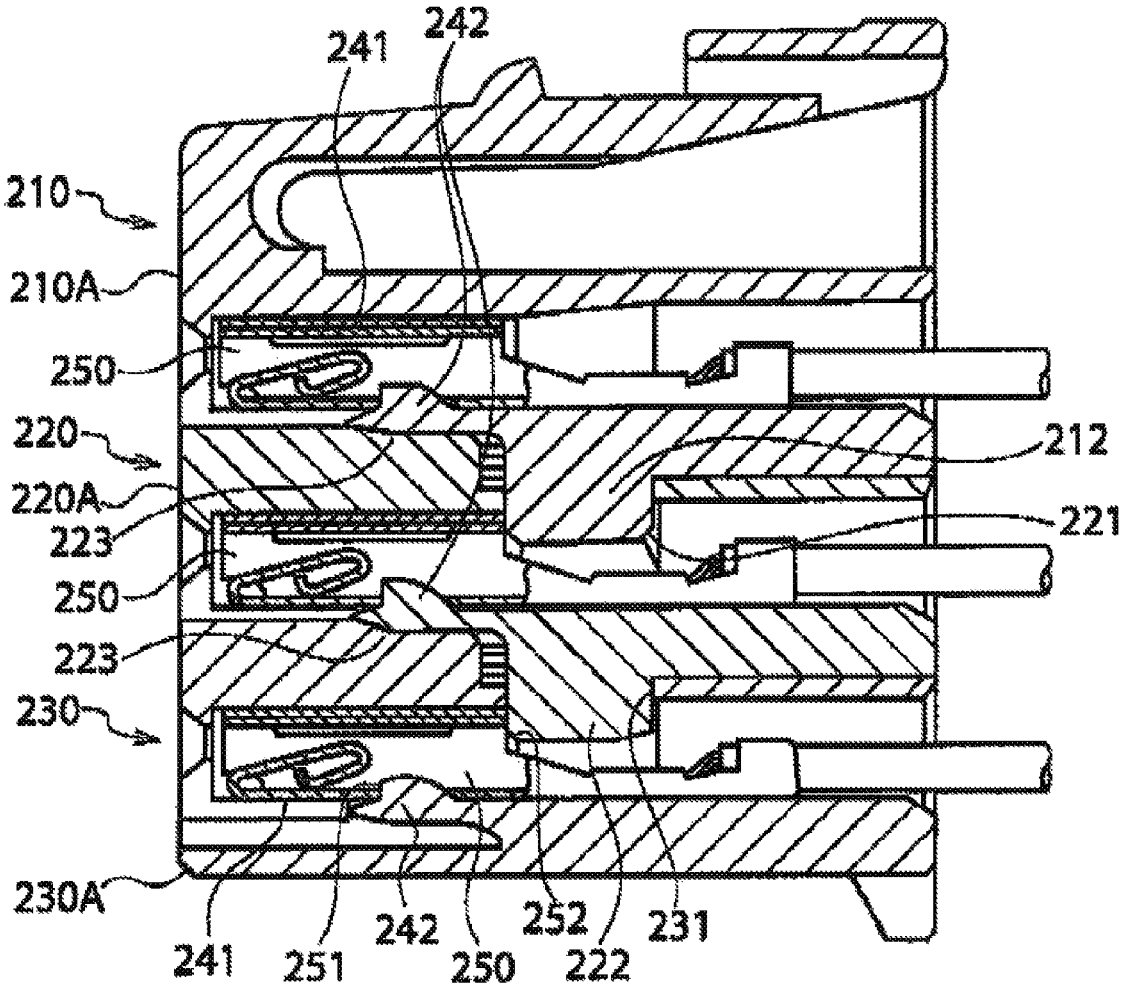
FIG .1 PRIOR ART
FIG. 1 is a cross-sectional view of a conventional coupling connector.
Figure 2:
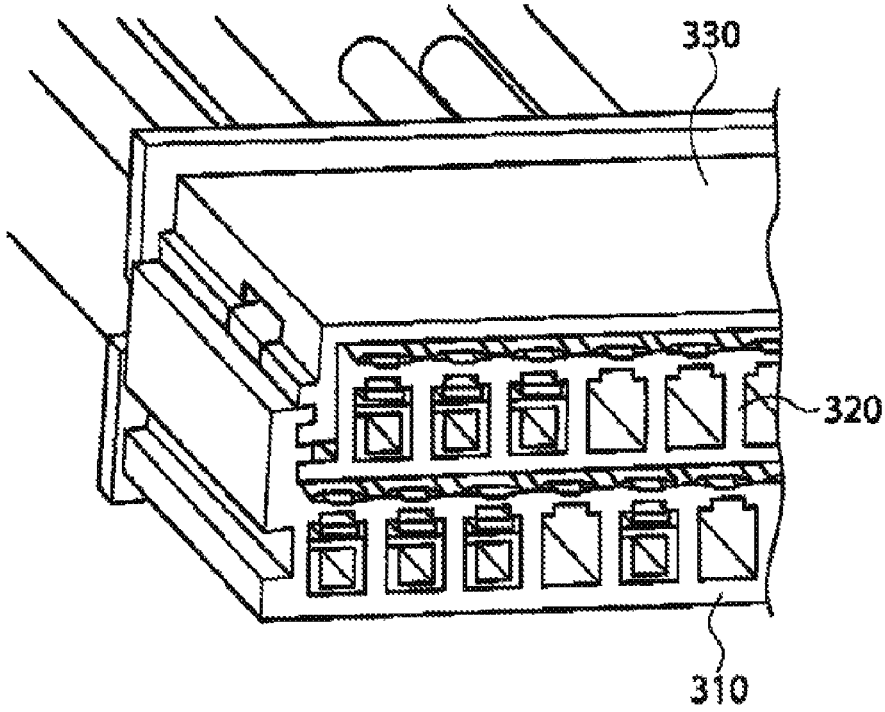
FIG. 2 PRIOR ART
FIGS. 2(*a*) and 2(*b*) are external appearance perspective views of another conventional coupling connector.
Figure 2:
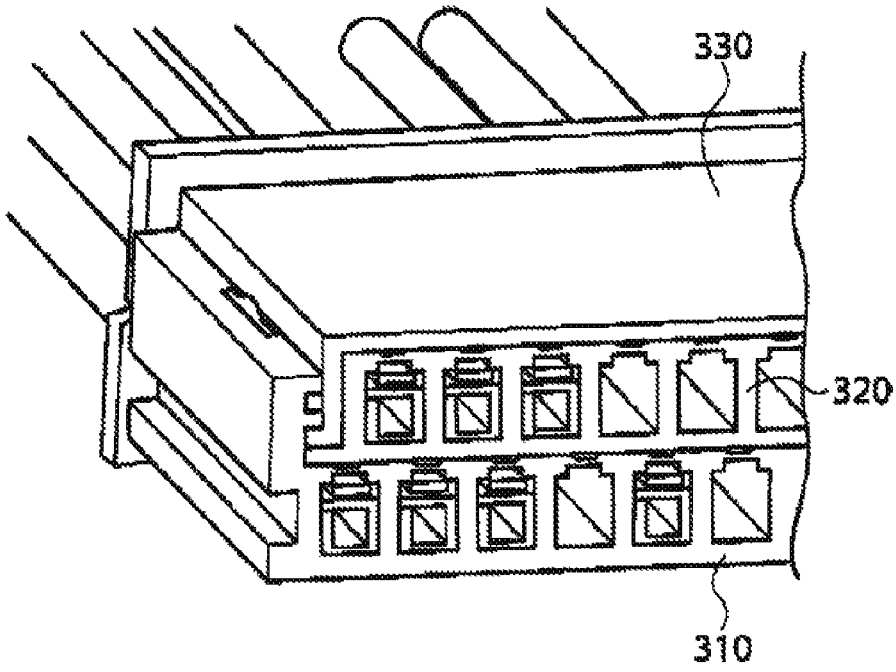
FIG. 2 PRIOR ART
Figure 3:
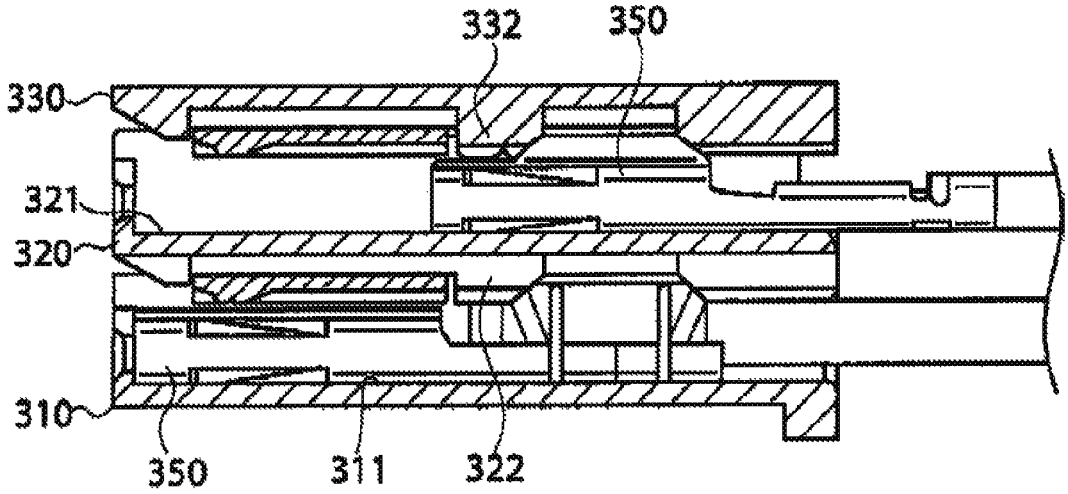
FIG. 3 PRIOR ART
FIGS. 3(*a*) and 3(*b*) are cross-sectional views of the conventional coupling connector illustrated in FIGS. 2(*a*) and 2(*b*)
Figure 3:
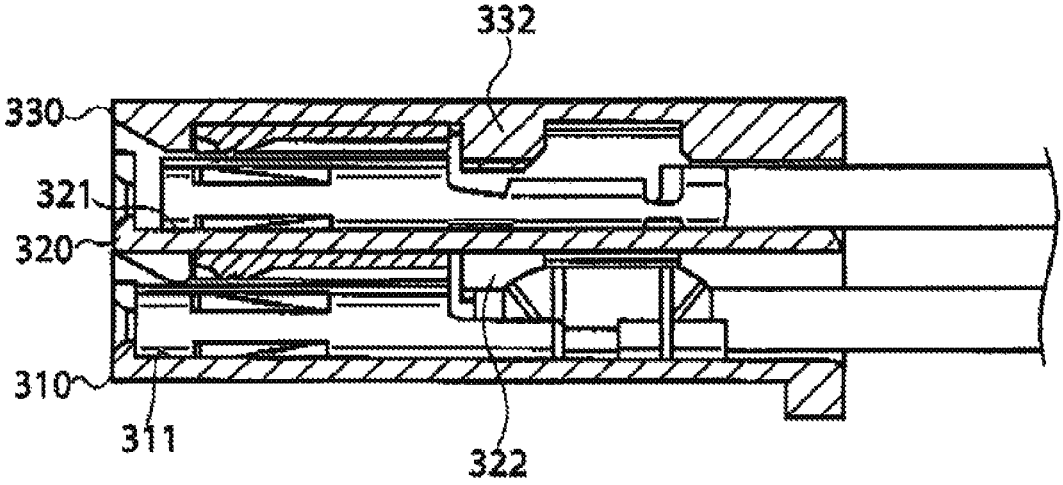
FIG. 3 PRIOR ART

A description is made below of an embodiment of the present invention while referring to the drawings.

Figure 4:
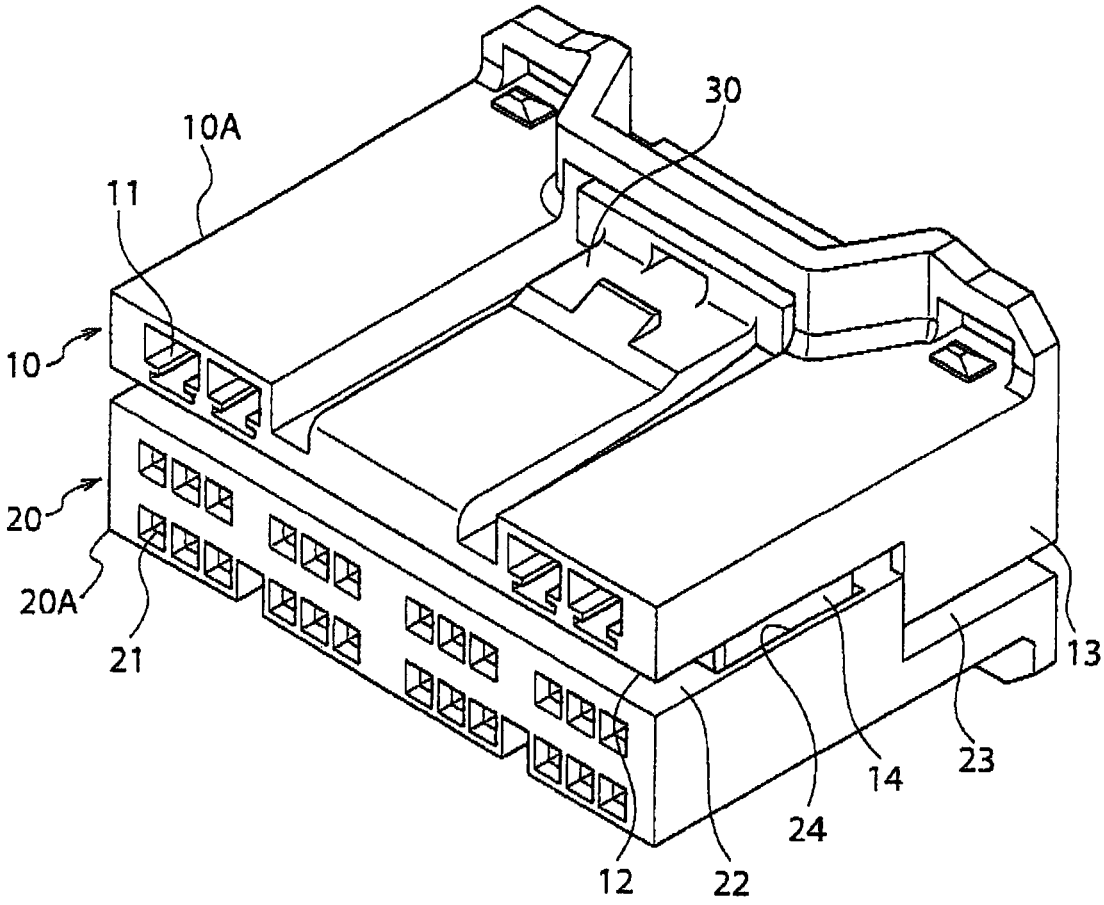
FIG. 4 is an external appearance perspective view illustrating a temporal engagement state of a coupling connector of an embodiment of the present invention.
Figure 5:
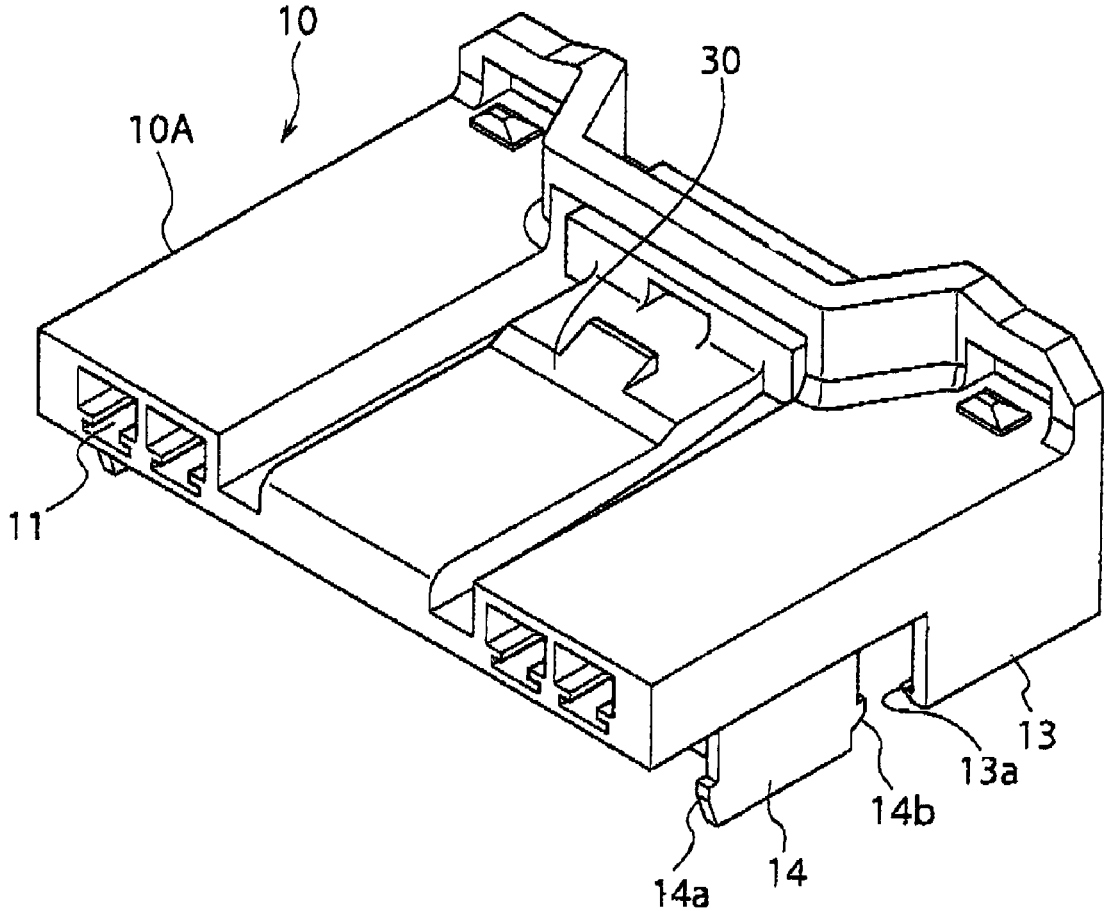
FIG. 5 is an external appearance perspective view of an upper connector housing that composes the coupling connector of the embodiment.
Figure 6:
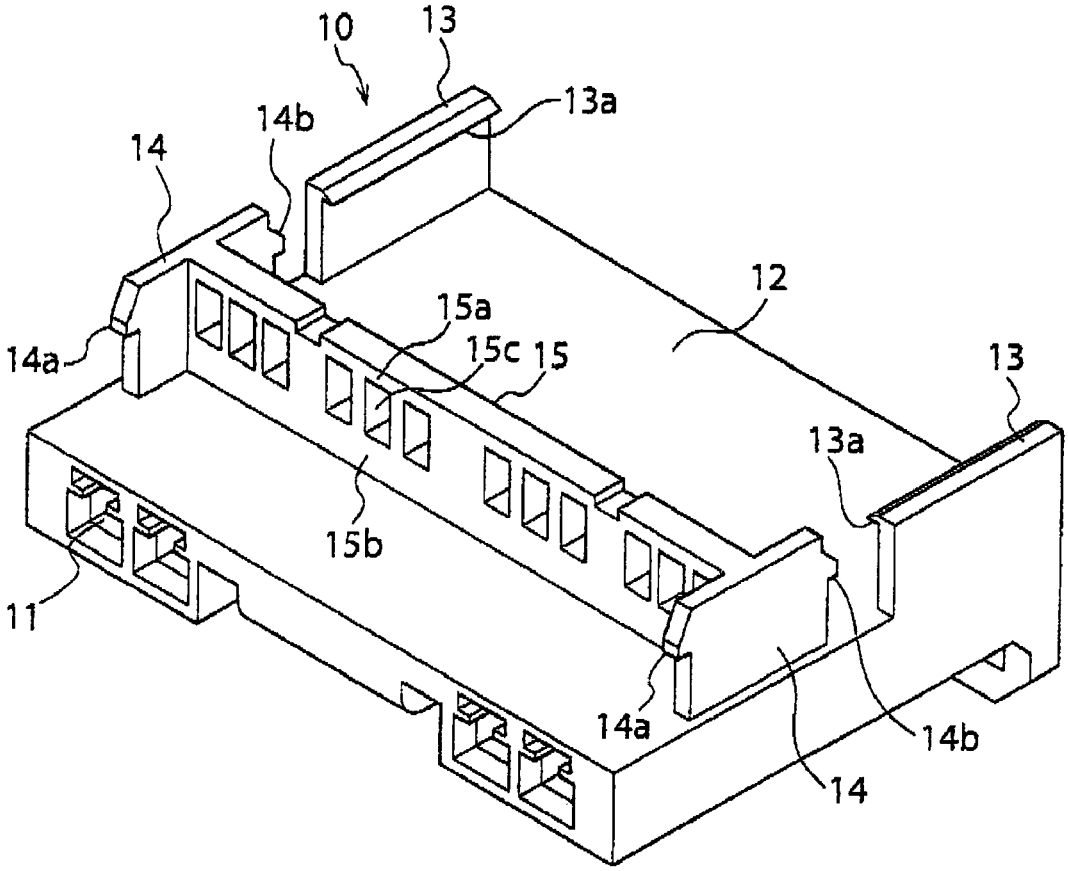
FIG. 6 is en external appearance perspective view of the upper connector housing when viewed reversely
Figure 7:
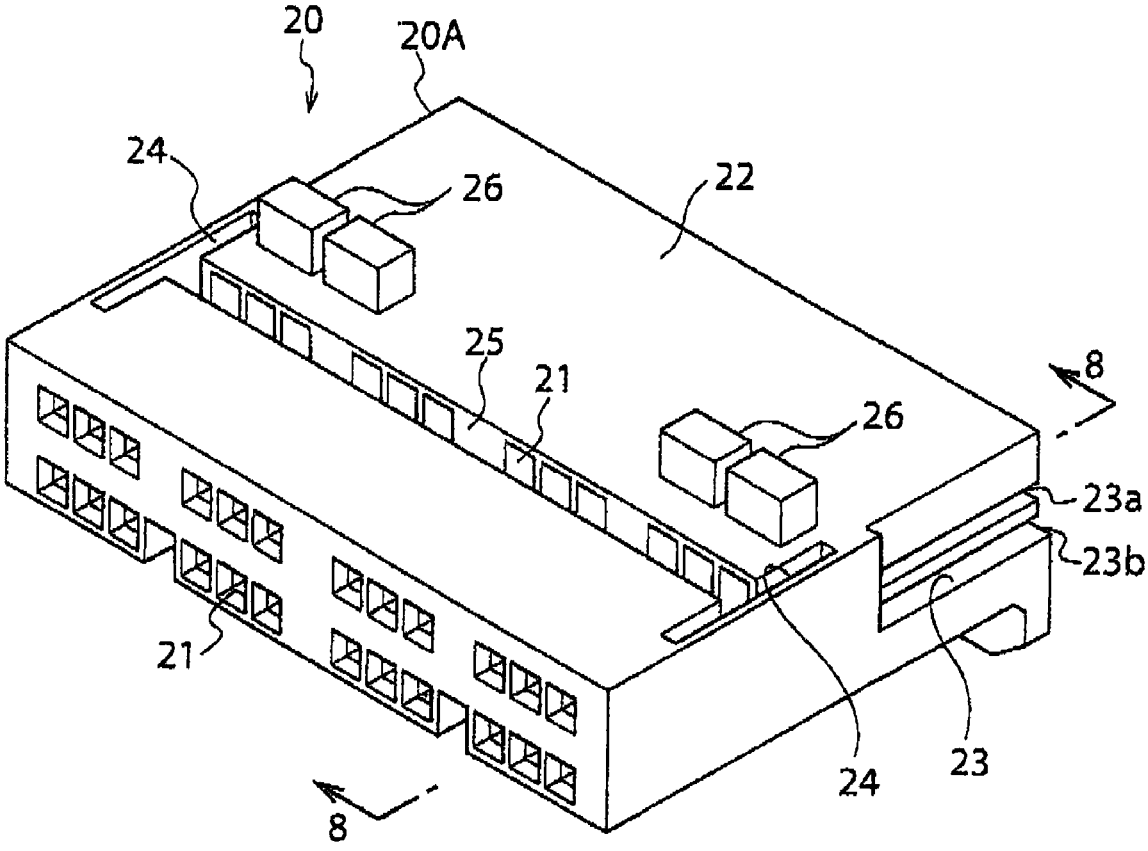
FIG. 7 is an external appearance perspective view of a lower connector housing that composes the coupling connector of the embodiment.
Figure 8:
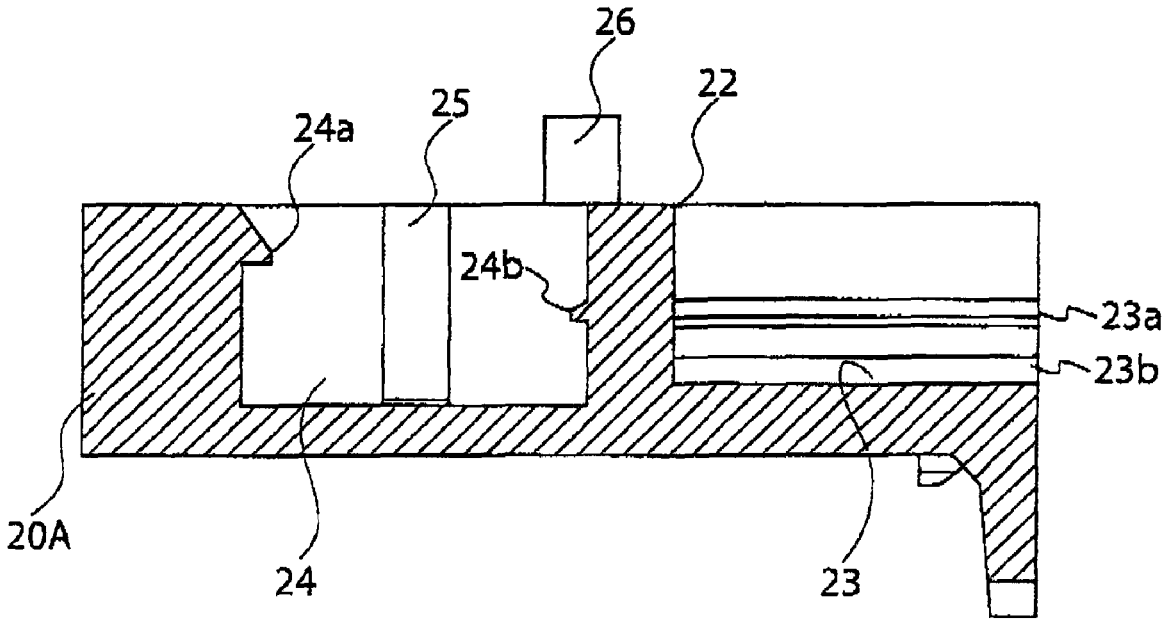
FIG. 8(*a*) is a cross-sectional view illustrating the state when the coupling connector is subjected to the temporal engagement.
Figure 9:
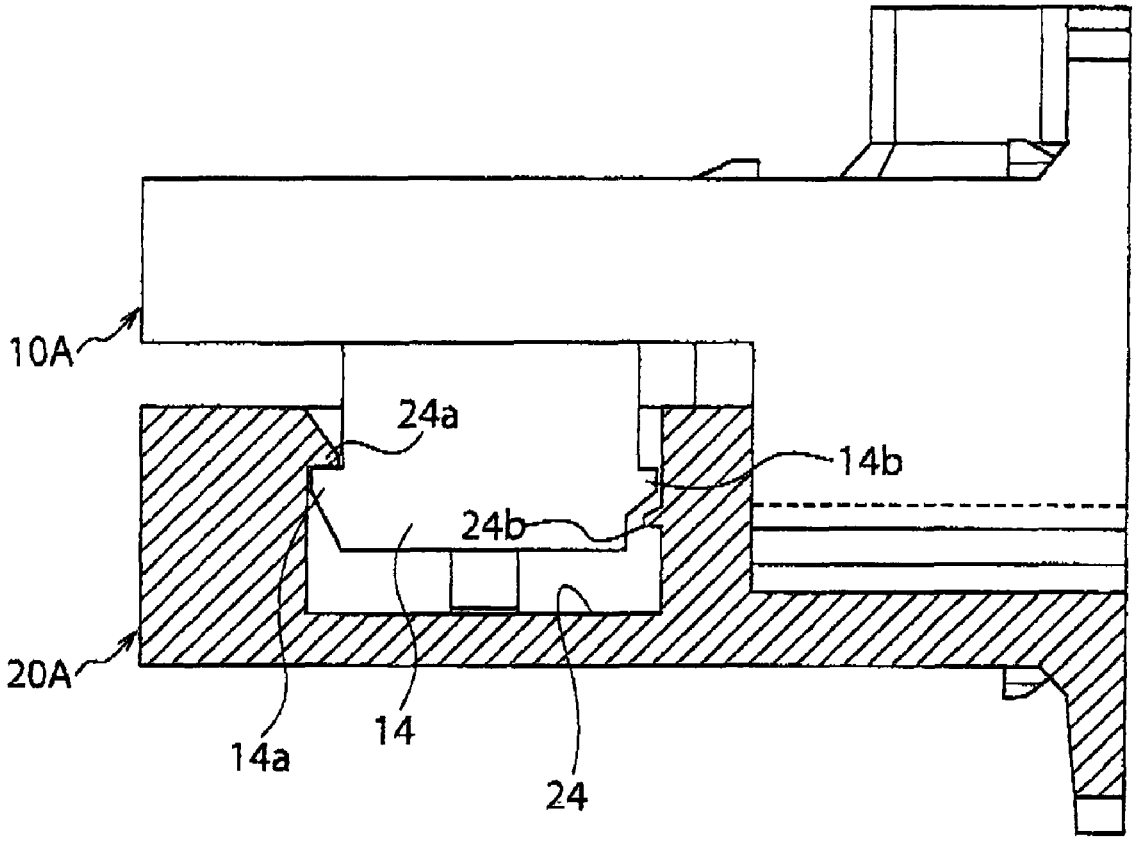
FIG. 9 is a cross-sectional view of the coupling connector when viewed at the same position as in FIG. 7, illustrating a coupling ongoing state where the upper and lower connector housings are held at a temporal engagement position.
Figure 10:
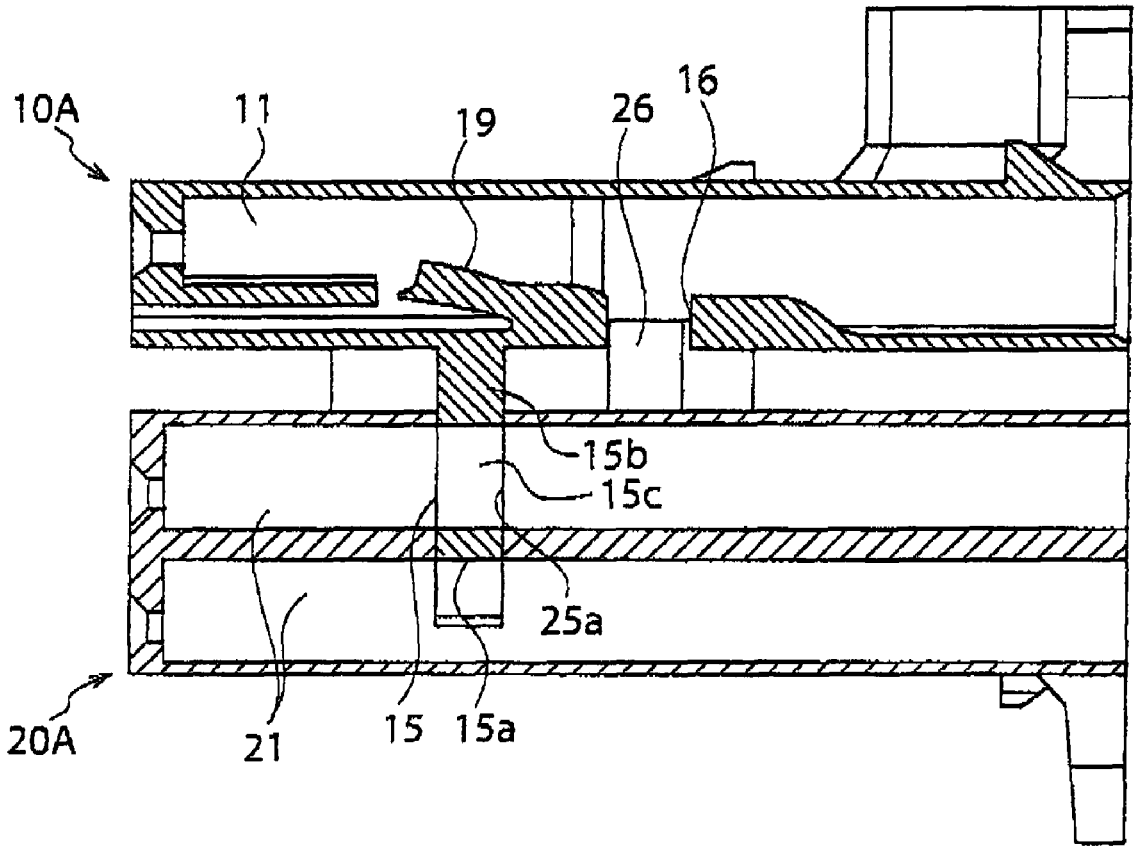
FIG. 10 is a cross-sectional view of the coupling connector when viewed at another position at a time of the temporal engagement state.
Figure 11:
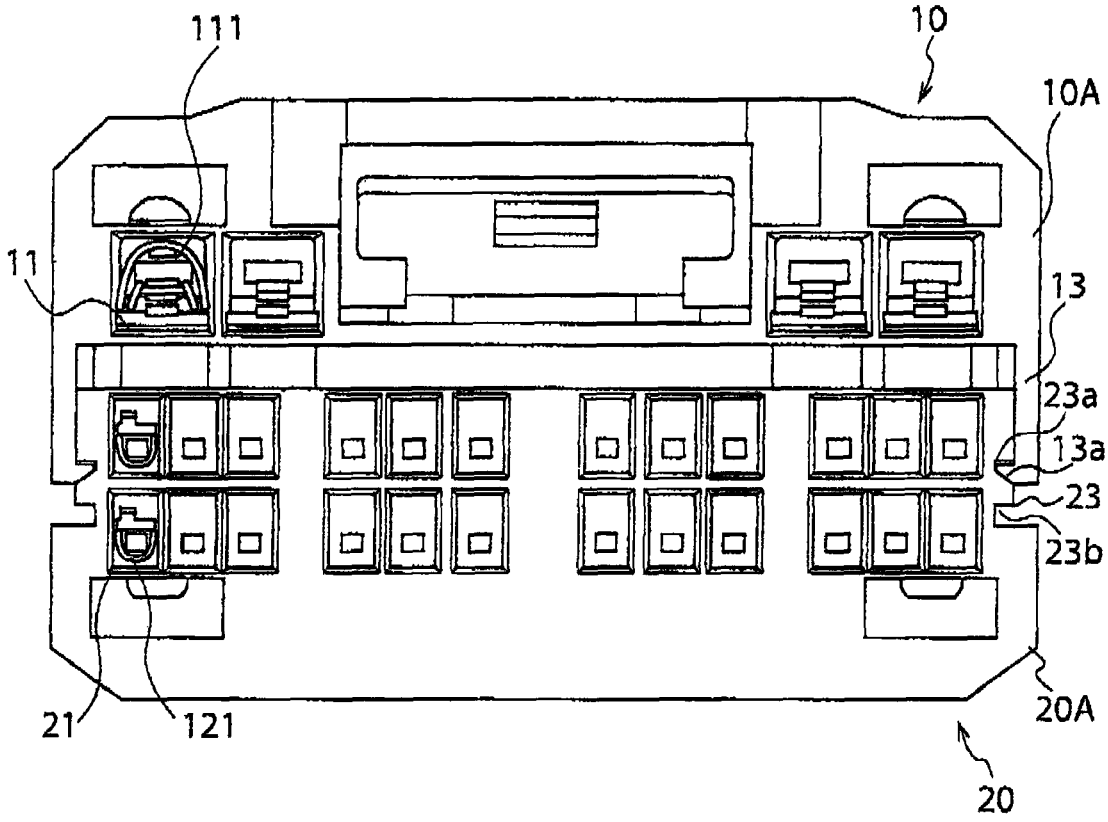
FIG. 11 is a rear view of the coupling connector at the time of the temporal engagement state.
Figure 12:
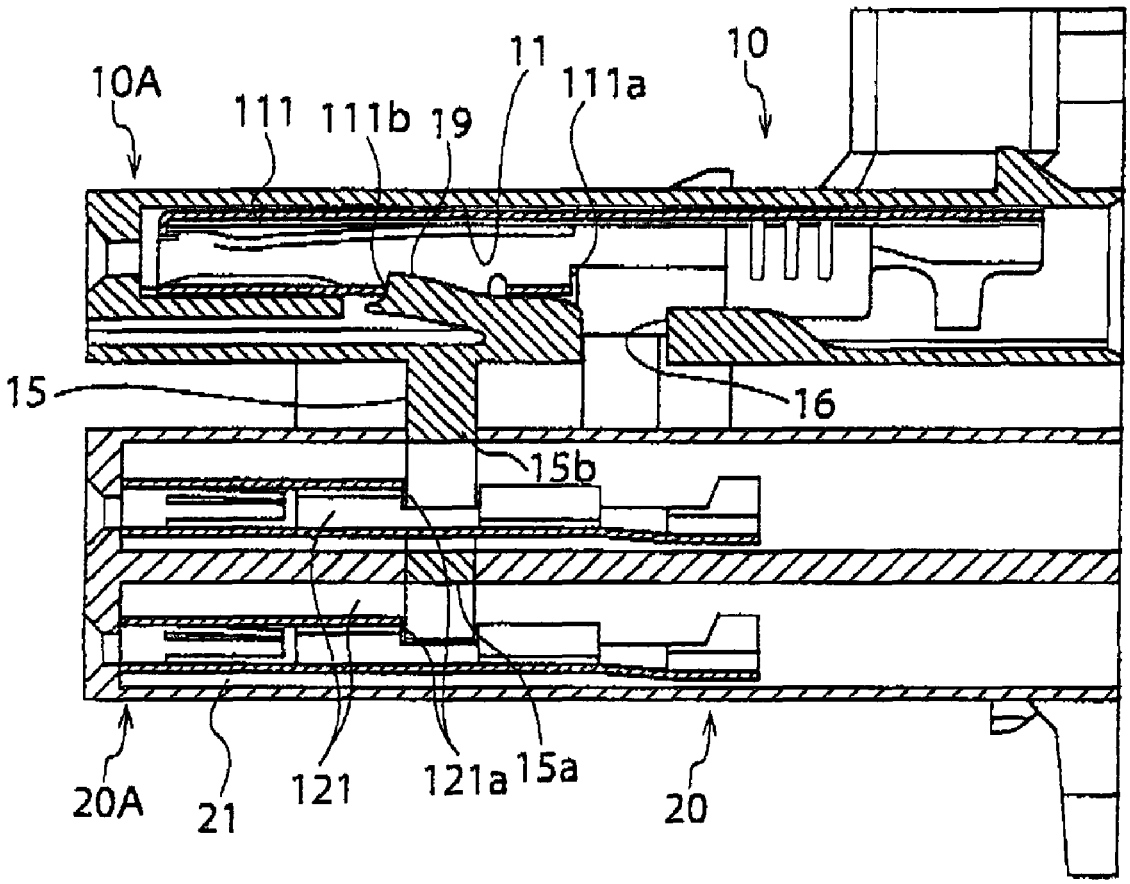
FIG. 12 is a cross-sectional view of the coupling connector when viewed at the same position as in FIG. 10, illustrating a state where terminals are inserted into the respective connector housings held in the temporal engagement state.
Figure 13:
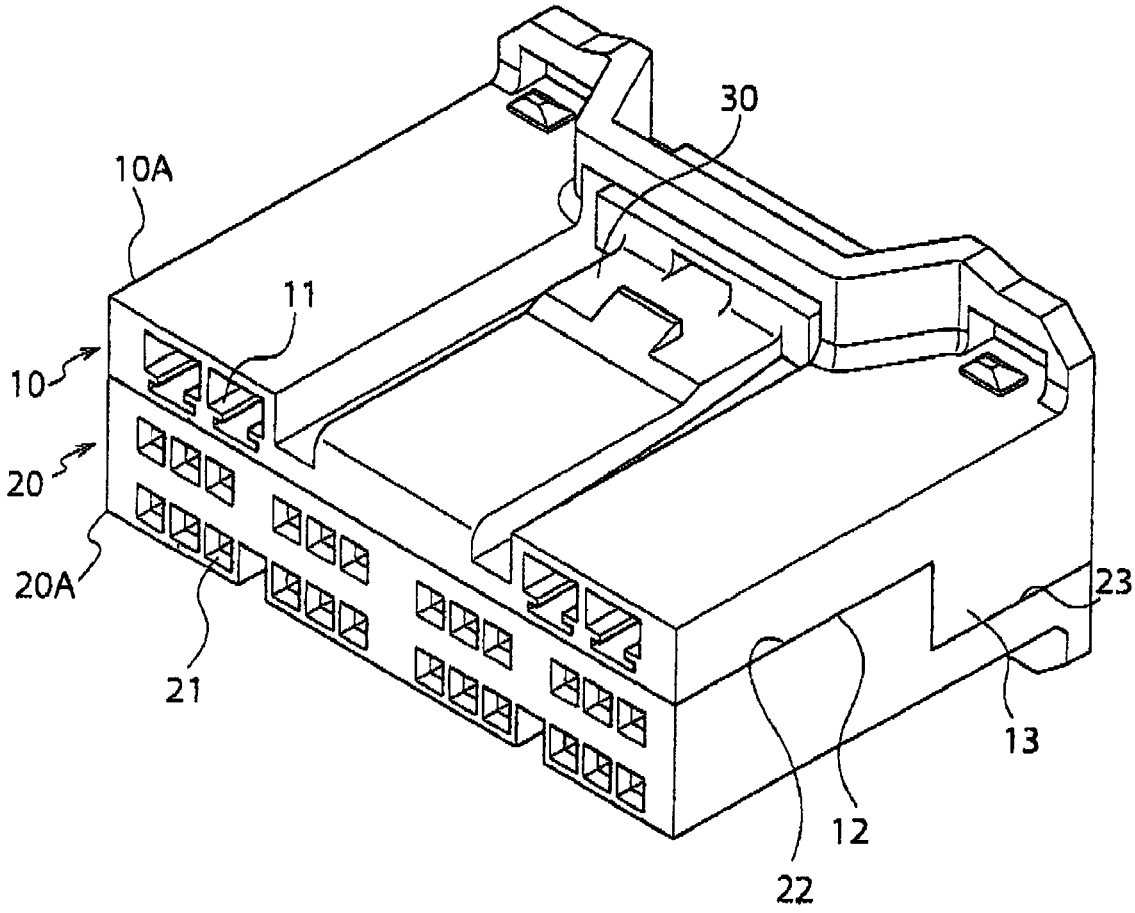
FIG. 13 is an external appearance perspective view of the coupling connector, illustrating a state where the coupling connector is finally engaged from the temporal engagement state.
Figure 14:
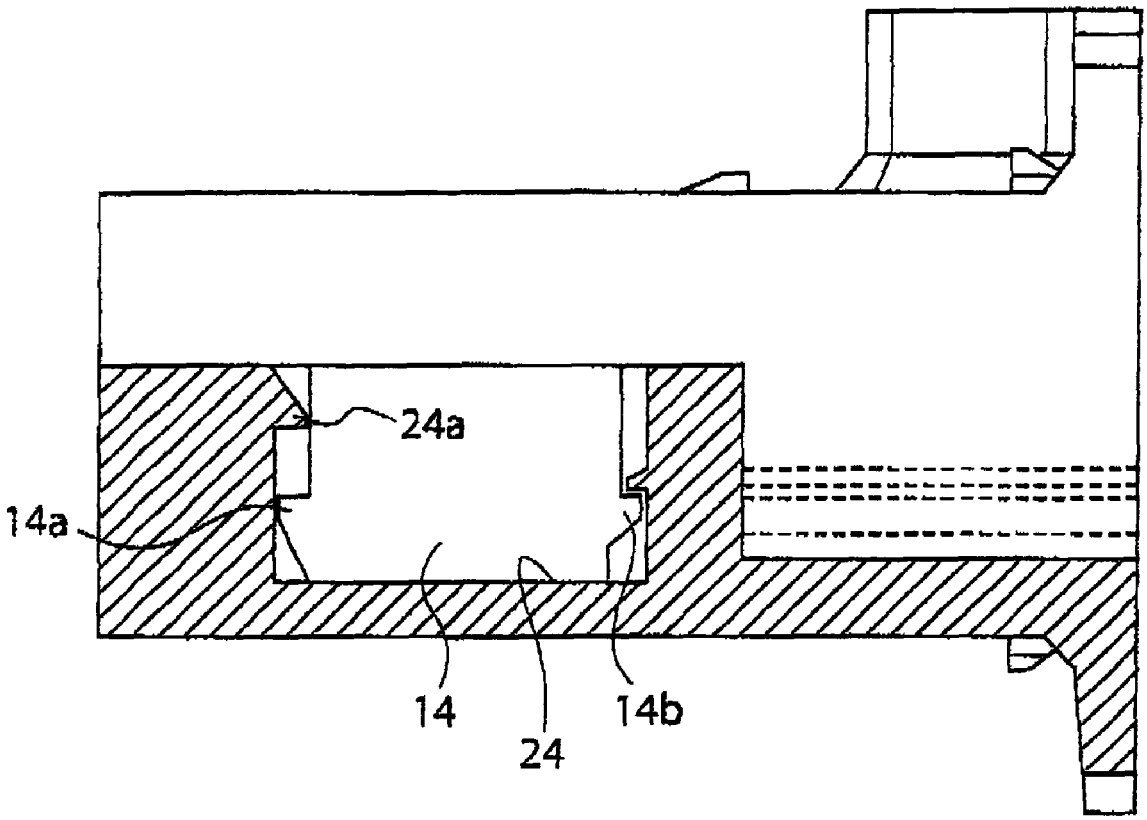
FIG. 14 is a cross-sectional view of the coupling connector at a time of a final engagement state when viewed at the same position as in FIG. 9.
Figure 15:
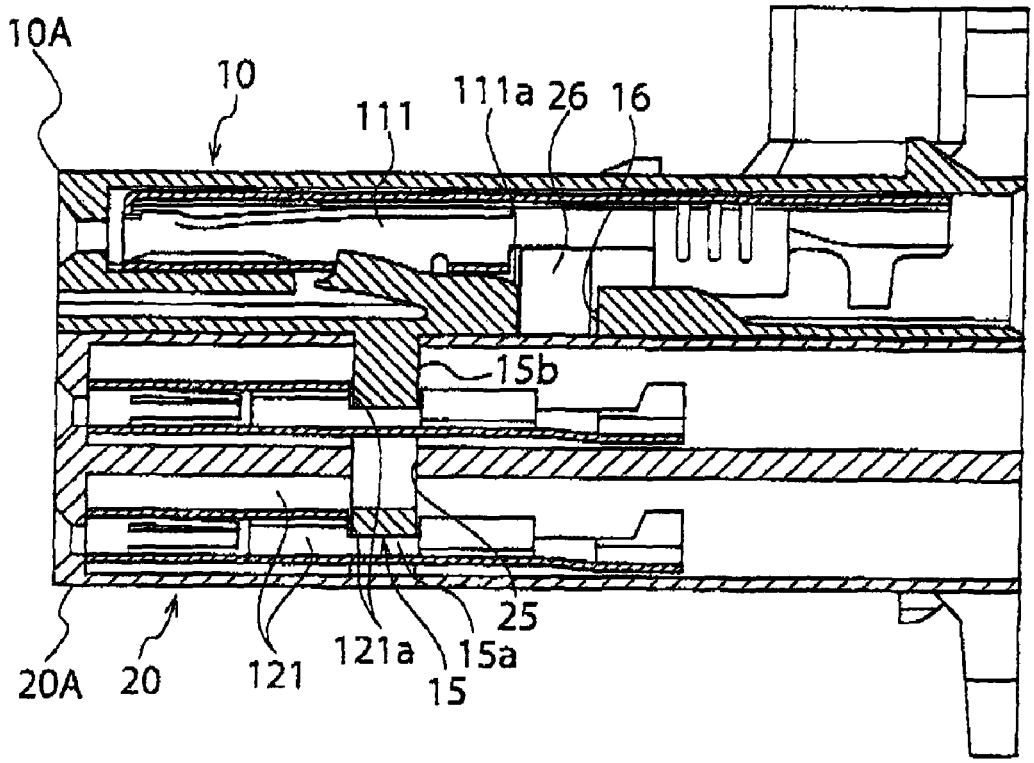
FIG. 15 is a cross-sectional view of the coupling connector at the time of the final engagement state when viewed at the same position as in FIG. 12.
Figure 16:
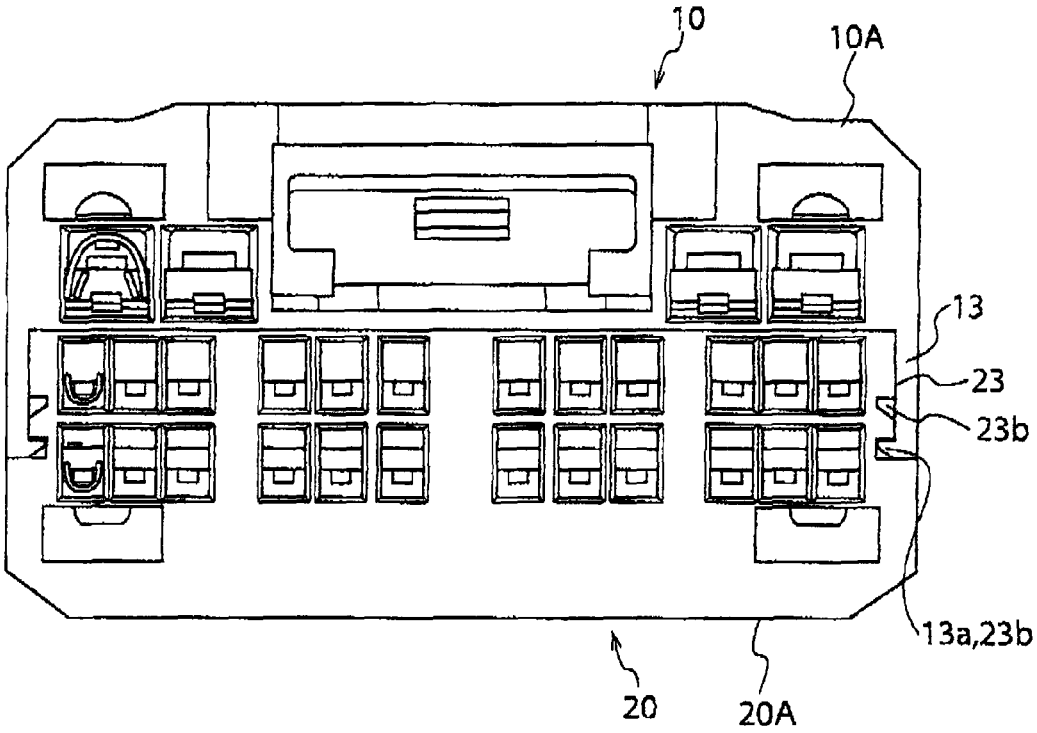
FIG. 16 is a rear view of the coupling connector at the time of the final engagement state.

FIG. 4 is an external appearance perspective view illustrating a state when a coupling connector of this embodiment is temporarily engaged. FIG. 5 is an external appearance perspective view of an upper connector housing that composes the coupling connector of this embodiment. FIG. 6 is an external appearance perspective view of the upper connector housing when viewed reversely. FIG. 7 is an external appearance perspective view of a lower connector housing that composes the coupling connector of this embodiment FIG. 8 is cross-sectional view taken along arrows 8-8 of FIG. 7. FIG. 9 is a cross-sectional view of the coupling connector when viewed at the same position as in FIG. 7, illustrating a coupling ongoing state where the upper and lower connector housings are held at a temporal engagement position. FIG. 10 is a cross-sectional view of the coupling connector when viewed at another position at a time of such a temporal engagement state. FIG. 11 is a rear view of the coupling connector at the time of the temporal engagement state. FIG. 12 is a cross-sectional view of the coupling connector when viewed at the same position as in FIG. 10, illustrating a state where terminals are inserted into the respective connector housings held in the temporal engagement state. FIG. 13 is an external appearance perspective view of the coupling connector, illustrating a state where the coupling connector is finally engaged from the temporal engagement state. FIG. 14 is a cross-sectional view of the coupling connector at a time of a final engagement state when viewed at the same position as in FIG. 9. FIG. 15 is a cross-sectional view of the coupling connector at the time of the final engagement state when viewed at the same position as in FIG. 12. FIG. 16 is a rear view of the coupling connector at the time of the final engagement state.

As illustrated in FIGS. 4 and 13, this coupling connector is formed by stacking an upper connector 10 and a lower connector 20 vertically on each other and coupling the upper and lower connectors 10 and 20 to each other. As illustrated in FIG. 12, the respective connectors 10 and 20 are formed by inserting terminals ill and 121 from rear ends of synthetic resin-made connector housings 10A and 20A thereof having a rectangular box shape.

As illustrated in FIGS. 10 and 12, the upper connector housing 10A includes a flexible lance 19 in each of terminal housing chambers 11. Then, when the terminal 111 is inserted from the rear of the lance 19, the lance 19 engages with an engaging recessed portion 111*b* of the terminal 111. In such a way, the terminal 111 is prevented from being detached to the rear (primarily engaged). Moreover, though not illustrated, the lower connector housing 20A includes, in each of the terminal housing chambers 11, a lance that exerts a similar function to that of the lance 19 according to needs.

On an upper surface of a widthwise center portion of the upper connector housing 10A, a lock arm 30 is provided, which locks the upper and lower connectors 10 and 20 together with each other at the time of being fitted to the opposite-side connector. Moreover, on both sides of a portion where the lock arm 30 is provided, the terminal housing portions 11 are arranged two by two. These terminal housing chambers 11 of the upper connector housing 10A. axe arrayed side by side in line at the same height. Furthermore, in the lower connector housing 20A, a large number of terminal housing chambers 21 are arrayed vertically at two stages.

As illustrated in FIGS. 7 and 10, on longitudinal center portions of a lower surface wall (mating surface) 12 of the upper connector housing 10A and of an upper surface wall (mating surface) 22 of the lower connector housing 20A, there are provided insertion recessed portions 16 and 25, respectively, while shifting positions thereof from each other. Moreover, together with these, as illustrated in FIGS. 6 and 10, there are provided terminal engaging projection portions 15 and 26 inserted into the respective insertion recessed portions 16 and 25 of the opposite-side connector housings.

Here, the insertion recessed portions 16 of the upper connector housing 10A and the terminal engaging projection portions 26 of the lower connector housing 20A, which are inserted thereinto, are provided so as to correspond to positions of the terminal housing chambers 11 of the upper connector housing 10A. Moreover, the insertion recessed portion 25 of the lower connector housing 20A and the terminal engaging projection portion 15 of the upper connector housing 10A, which is inserted thereinto, are provided so as to correspond to positions of the terminal housing chambers 21 of the lower connector housing 20A.

Specifically, a several number of the terminal housing chambers 11 of the upper connector, housing 10A are only arranged. Hence, the insertion recessed portions 16 of the upper connector housing 10A and the terminal engaging projection portions 26 of the lower connector housing 20A are provided in such forms as holes and blocks, which are independent one by one.

Moreover, a large number of the terminal housing chambers 21 of the lower connector housing 20A are arrayed side by side. Hence, the insertion recessed portion 25 of the lower connector housing 20A and the terminal engaging projection portion 15 of the upper connector housing 10A are provided in such forms as continuous groove and wall.

The terminal engaging projection portions 15 and 26 are individually inserted to a final engagement position, and thereby engage with constricted portions 111*a* and 121*a* of the terminals 121 and 111 inserted into the terminal housing chambers 21 and 11 of the opposite-side connector housings 20A and 10A. As a result, the terminal engaging projection portions 15 and 26 perform a function (function as retainers) to inhibit the rearward detachment of the terminals 121 and 111 concerned.

In the lower connector housing 20A, the plurality of terminal housing chambers 21 are formed vertically at two stages. Moreover, as illustrated in FIGS. 6 and 12, the upper connector housing 10A includes opening portions 15*c* and two engagement wall portions 15*a* and 15*b* in the terminal engaging projection 15. Then, when both of the connector housings 10A and 20A are located at the temporal engagement position thereof, the opening portions 15*c* allow insertion of the terminals 121 into the terminal housing chambers 21 of the lower connector housing 20A Meanwhile, when both of the connector housings 10A and 20A. are located at the final engagement position, the two engagement wall portions 15*a* and 15*b* engage the terminals 121, which are inserted into the terminal housing chambers 21 located at upper and lower stages in the lower connector housing 20A, simultaneously and together.

Moreover, the upper and lower connector housings 10A and 20A include: temporarily engaging means for holding both of the connector housings 10A and 20A at the temporal engagement position; and finally engaging means for holding both of the connector housings 10A and 20A at the final engagement position. These engaging means are provided on front and rear sides of the connector housings 10A and 20A.

As illustrated in FIG. 6, as front engaging means of the upper connector housing 10A, front lock plates 14 coupled in a T-shape to both ends of the wall-like terminal engaging projection portion 15 are provided. Then, on front and rear end edges of each of the front long plates 14, a temporal engagement projection 14*a* and a final engagement projection 14*b* are provided. Moreover, as illustrated in FIGS. 7, 8, and 9, as front engaging means of the lower connector housing 20A, front lock grooves 24 connected in a T-shape to both ends of the groove-like insertion recessed portion 25 are provided. Then, on front and rear inner edges of each of the lock grooves 24, a temporal engagement projection 24*a* and a final engagement projection 24*b* are provided. The temporal engagement projections 14*a* and the final engagement projections 14*b* on the lock plate 14 side engage with the temporal engagement projections 24*a* and the final engagement projections 24*b* on the lock groove 24 side, respectively. As a result, the connector housings 10A and 20A are individually held at the temporal engagement position and the final engagement position.

As illustrated in FIGS. 5 to 8, 11, and 16, as rear engaging means of the upper connector housing 10A, rear lock plates 13 suspended downward axe provided on both widthwise ends of the rear end of the connector housing 10A Then, engagement projections 13*a* are provided on tip ends on inner surface sides of the rear lock plates 13. Moreover, as rear engaging means of the lower connector housing 20A, recessed portions 23 which receive the lock plate 13 are provided on both widthwise ends of the rear end of the connector housing 20A. Then, temporal engagement grooves 23*a* and final engagement grooves 23*b*, with which the engagement projections 13*a* on the lock plate 13 side engage, are provided on wall surfaces of the recessed portions 23. These engagement projections 13*a* on the lock plate 13 side engage with the temporal engagement grooves 23*a* on the recessed portions 23 side, and thereby hold the connector housings 10A and 20A at the temporal engaging position, and then engage with the final engagement grooves 23*b* on the recessed portions 23 side. As a result, the connector housings 10A and 20A are held at the final engagement position.

Here, the temporal engagement projections 14*a* and 24*a* of the front lock plates 14 and the front lock grooves 24 and the engagement projections 13*a* of the rear lock plates 13 and the temporal engagement grooves 23*a* correspond to the temporarily engaging means. Moreover, the final engagement projections 14*b* and 24*b* of the front lock plates 14 and the front lock grooves 24 and the engagement projections 13*a* of the rear lock plates 13 and the final engagement grooves 23*b* correspond to the finally engaging means.

Next, an assembly procedure is described.

First, as illustrated in FIGS. 9, 11, and 12, the upper connector housing 10A and the lower connector housing 20A are stacked vertically on each other, and are temporarily engaged with each other. Specifically, the engagement projections 13*a* of the rear lock plates 13 of the upper connector housing 10A engage with the temporal engagement grooves 23*a* of the recessed portions 23 of the lower connector housing 20A. Moreover, the temporal engagement projections 14*a* of the front lock plates 14 of the upper connector housing 10A engage with the temporal engagement projections 24*a* of the lock grooves 24 of the lower connector housing 20A. The temporal engagement is performed as described above, whereby the connector housings 10A and 20A are connected to each other so as not to be spaced apart from each other In this state, as illustrated in FIG. 12, the terminals 111 and 121 are inserted into the terminal housing chambers 11 and 21 of the respective connector housings 10A and 20A from the rear ends thereof. At this time, the terminal engaging projection portion 15 of the upper connector housing 10A is entering the insertion recessed portion 25 of the lower connector housing 20*k* However, the opening portions 15*c* are located on routes through which the terminals 121 are inserted, and accordingly, the terminals 121 are inserted without any trouble.

Next, when the terminals 111 and 121 are inserted, the upper and lower connector housings 10A and 20A are pushed. against each other so as to be finally engaged with each other. Then, as illustrated in FIGS. 13 to 16, the engagement projections 13*a* of the rear lock plates 13 of the upper connector housing 10A engage with the final engagement grooves 23*b* of the recessed portions 23 of the lower connector housing 20*k* Moreover, the final engagement projections 14*b* of the front lock plates 14 of the upper connector housing 10A engage with the final engagement projections 24*b* of the lock grooves 24 of the lower connector housing 20A. In such a way, both of the connector housings 10A and 20A turn to the final engagement state. As a result, the two connectors 10 and 20 are coupled to each other.

In this state, as illustrated in FIG. 15, the terminal engaging projection portions 26 of the lower connector housing 20A deeply enter the insertion recessed portions 16 of the upper connector housing 10A, and engage with the constricted portions 111*a* of the terminals 111 inserted into the terminal housing chambers 11. Moreover the terminal engaging projection portion 15 of the upper connector housing 10A deeply enters the insertion recessed portion 25 of the lower connector housing 20A, and engages with the constricted portions 121*a* of the terminals 121 individually inserted into the terminal housing chambers 21 located at the upper and lower stages.

As described above, at the time when the upper connector housing 10A and the lower connector housing 20A are coupled to each other, the terminal engaging projection portions 15 and 26 provided on the opposite side connector housings 10A and 20A mutually engage with the constricted portions 111*a* and 121*a* of the terminals ill and 121. As a result, the terminals 111 and 121 are prevented from being detached. Hence, without requiring a superfluous cover or the like, the coupling connector can exert sufficient terminal holding force on any stage thereof by means of the minimum number of components.

Moreover, in the coupling connector of this embodiment, the connector housings 10A and 20A can be held distinctively at the temporal engagement position and the final engagement position. Therefore, the coupling connector can be assembled with ease. Moreover, in the coupling connector of this embodiment, the terminals 111 and 121 can be inserted into the terminal housing chambers 11 and 21 of the respective connector housings 10A and 20A in a state where the connector housings 10A and 20A are held at the temporal engagement position. Then, the connector housings 10A and 20A are pushed to the final engagement position from this state, whereby the connector housings 10A and 20A are coupled to each other. In such a way, the terminals 111 and 121 are engaged with the connector housings so as to be prevented from being detached. Therefore, the coupling connector can be assembled with ease.

Industrial Applicability

The coupling connector of the present invention can exert the sufficient terminal holding force on any stage thereof by means of the minimum number of components.

The invention claimed is:

1. A coupling connector comprising:

a plurality of connector housings stacked vertically on each other and coupled to each other, the connector housings including:

terminal housing chambers configured to have terminals inserted into the terminal housing chambers of the connector housings from the rear ends thereof, each terminal having a constricted portion, insertion recessed portions arranged on a mating wall of one of the connector housings and a mating wall of the other connector housing among a pair of the connector housings directly stacked on each other, and terminal engaging projection portions which are arranged on the mating wall of the one of the connector housings and the mating wall of the other connector housing, are insertable into the insertion recessed portions provided on the mating walls of the opposite-side connector housing opposite thereto when the connector housings are stacked on each other, engage with the constricted portions of the terminals inserted into the terminal housing chambers of the opposite-side connector housings by being individually inserted to a final engagement position, and inhibit rearward detachment of the terminals thus engaged.

2. The coupling connector according to claim 1, further comprising:

temporarily engaging means for holding both of the connector housings at a temporal engagement position; and finally engaging means for holding both of the connector housings at the final engagement position, wherein the temporarily engaging means and the finally engaging means are provided in the one of the connector housings and the other connector housing.

3. The coupling connector according to claim 1, wherein a plurality of stages of the terminal housing chambers are provided vertically in at least one connector housing of the pair of connector housings, and engagement wall portions are provided on the terminal engaging projection portions in the other connector housing stacked on the one connector housing, the engagement wall portions allowing insertion of the terminals into the terminal housing chambers of the one connector housing when both of the connector housings are located at the temporal engagement position, and engaging the terminals inserted into the terminal housing chambers of the one connector housing when both of the connector housings are located at the final engagement position.

* * * * *